US010772175B1

(12) United States Patent
Liu et al.

(10) Patent No.: US 10,772,175 B1
(45) Date of Patent: Sep. 8, 2020

(54) LIGHTING APPARATUS

(71) Applicant: XIAMEN ECO LIGHTING CO. LTD., Xiamen (CN)

(72) Inventors: Wei wei Liu, Fujian (CN); Hong Kui Jiang, Fujian (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/546,162

(22) Filed: Aug. 20, 2019

(51) Int. Cl.
*H05B 45/20* (2020.01)
*H05B 45/37* (2020.01)

(52) U.S. Cl.
CPC ..... *H05B 45/37* (2020.01); *H05B 45/20* (2020.01)

(58) Field of Classification Search
CPC .... H05B 33/02; H05B 33/08; H05B 33/0803; H05B 33/0806; H05B 33/0812; H05B 33/0815; H05B 33/0854; H05B 33/0872; H05B 45/10; H05B 45/14; H05B 45/18; H05B 45/20; H05B 45/24; H05B 45/28; H05B 45/30; H05B 45/305; H05B 45/31; H05B 45/32; H05B 45/325; H05B 45/37
See application file for complete search history.

(56) References Cited

U.S. PATENT DOCUMENTS

| | | | | |
|---|---|---|---|---|
| 9,844,113 | B2 * | 12/2017 | Yan | H05B 45/44 |
| 2006/0237636 | A1 * | 10/2006 | Lyons | H05B 35/00 250/228 |
| 2013/0229120 | A1 * | 9/2013 | Choutov | H05B 45/10 315/186 |
| 2013/0313983 | A1 * | 11/2013 | Radermacher | H05B 45/48 315/187 |
| 2014/0070710 | A1 * | 3/2014 | Harris | H05B 47/18 315/185 R |
| 2015/0077001 | A1 * | 3/2015 | Takahashi | H05B 45/40 315/193 |
| 2015/0077002 | A1 * | 3/2015 | Takahashi | H05B 45/37 315/193 |
| 2015/0312983 | A1 * | 10/2015 | Hu | F21K 9/23 315/186 |
| 2015/0373790 | A1 * | 12/2015 | Boswinkel | H05B 45/46 315/186 |
| 2016/0088697 | A1 * | 3/2016 | Yan | H05B 45/37 315/205 |
| 2019/0110343 | A1 * | 4/2019 | Van Kaathoven | H05B 45/10 |
| 2019/0191512 | A1 * | 6/2019 | Zeng | F21V 23/04 |

* cited by examiner

*Primary Examiner* — Jason Crawford
(74) *Attorney, Agent, or Firm* — Chun-Ming Shih; LanWay IPR Services

(57) ABSTRACT

A lighting apparatus, includes a first light source, a second light source, a current source, a PWM circuit and a switch circuit. The first light source and the second light source emit lights of different color temperatures. A current source is for generating a driving current. The PWM circuit is used for generating a PWM signal. The switch circuit is for guiding the driving current to either the first light source or the second light source by reference to the PWM signal.

9 Claims, 3 Drawing Sheets

LIGHTING APPARATUS

FIELD

The present invention is related to a lighting apparatus and more particularly related to a lighting apparatus with desired color temperature.

BACKGROUND

LED (Light Emitted Diode) are currently widely used in new lighting design. More and more traditional lighting devices are replaced with LED lighting devices for LED having low cost and high optical efficiency.

To achieve better optical effect, color temperature is playing a more and more important role. In some cases, the color temperature of a LED lighting apparatus is preferred to be kept at a desired color temperature. In some other cases, the color temperature of a LED lighting apparatus is preferred to be adjusted dynamically by users with manual control or under automatic control.

To achieve a desired color temperature, more than one types of LED devices may be used together to achieve a mixed optical parameter, e.g. color temperature. In past, more than one control circuits need to be prepared for each type of LED devices. But, such design usually involves higher cost and may cause some instable light output.

Therefore, it is preferred to design a better lighting apparatus with more stable output and lower manufacturing cost.

SUMMARY OF INVENTION

According to a preferred embodiment, a lighting apparatus includes a first light source, a second light source, a current source, a pulse width modulation (PWM) circuit for generating a PWM signal and a switch circuit.

The first light source emits a first light with a first optical parameter. The second light source emits a second light with a second optical parameter. The first optical parameter and the second optical parameter comprise color temperature and/or light spectrum distribution, e.g. different strengths on different frequency segments. The first light source and the second light source may each include one more than one LED modules. To emit different color temperatures, different fluorescent layers may be disposed upon LED chips for generating different color temperatures.

The current source generates a driving current. For example, the current source may be various constant current circuits that may convert DC (Direct Current) or AC (Alternating Current) to a suitable driving current for driving LED modules to emit light.

The pulse width modulation (PWM) circuit is used for generating a PWM signal.

The switch circuit guides the driving current to either the first light source or the second light source by reference to the PWM signal so as by mixing the first light of the first optical parameter and the second light of the second optical parameter to obtain a desired mixed output light of a mixed optical parameter.

In some embodiments, when the PWM signal is at high level, the switch circuit guides the driving current to the first light source, and when the PWM signal is at low level, the switch circuit guides the driving current to the second light source. Usually, a PWM signal is a square wave that has consecutive high voltage levels and low voltage levels. When the PWM signal is at high voltage level, e.g. the PWM signal being at high level, the driving current is directed to drive the first light source. When the PWM signal is at low voltage level, e.g. the PWM signal being at low level, the driving current is directed to the second light source.

In some embodiments, the first optical parameter is a first color temperature and the second optical parameter is a second color temperature and a mixed color temperature of the mixed output light is adjusted by changing the PWM signal. For example, in a time period, the first light source is turned on for 70% of time while the second light source is turned on for 30% of time. In such case, the mixed color temperature appears to be 70% of the color temperature of the first light source plus 30% of the color temperature of the second light source.

In some embodiments, the first light source and the second light source do not receive the driving current at the same time. In other words, the first light source and second light source are controlled not to turn on at the same time according to the PWM signal.

In some embodiments, the first light source and the second light source are LED light sources.

In some embodiments, the PMW signal is also supplied to the current source for determining a current value of the driving current. In other words, the same PWM signal is used for adjusting or determining the mixed color temperature and also used for adjusting or determining the overall driving current, so as to adjust luminance level.

In some embodiments, the light apparatus also includes an AC/DC converter for converting an AC power source to a DC power source supplying to the current source for generating the driving current.

In some embodiments, the switch circuit includes a first switch unit connected in series with the first light source forming a first light path. A control gate of the first switch unit receives the PWM signal. The switch circuit also includes a second switch unit connected in series with the second light source forming a second light path. The second light path is connected with the first light path in parallel.

There is a one-way conductive unit with a first terminal connected to a control gate of the second switch unit and a first output terminal of the current source. A second terminal of the one-way conductive unit is connected between the first switch unit and the first light source.

In some embodiments, the first switch unit and the second switch unit are transistors.

In some embodiments, the switch circuit further includes a first voltage divider. The first voltage divider includes a first voltage divider resistor and a second divider resistor connected with the first light path in parallel. The control gate of the first switch unit is connected between the first voltage divider resistor and the second voltage divider resistor.

In some embodiments, the switch circuit may further include a second voltage divider. The second voltage divider includes a fourth voltage divider resistor and a fifth voltage divider resistor. The second voltage divider is connected with the second light path in parallel. The control gate of the second switch unit is connected between the fourth voltage divider resistor and the fifth voltage divider resistor.

In some embodiments, the switch circuit may also include a third voltage divider. The third voltage divider includes a third voltage divider resistor. The third voltage divider resistor is connected between a second terminal of the one-way conductor and a second output terminal of the current source.

In some embodiments, the one-way conductor is a diode device. The first output terminal is a positive terminal of the current source, and the second output terminal is a negative terminal of the current source.

In some embodiments, the lighting apparatus may also include a tuner module connected to the current source for adjusting the driving current according to the PWM signal.

In some embodiments, the lighting apparatus may also further include a tuner module connected to the current source for adjusting the driving current by inputting a second PWM signal.

DETAILED DESCRIPTION

Figure 1:
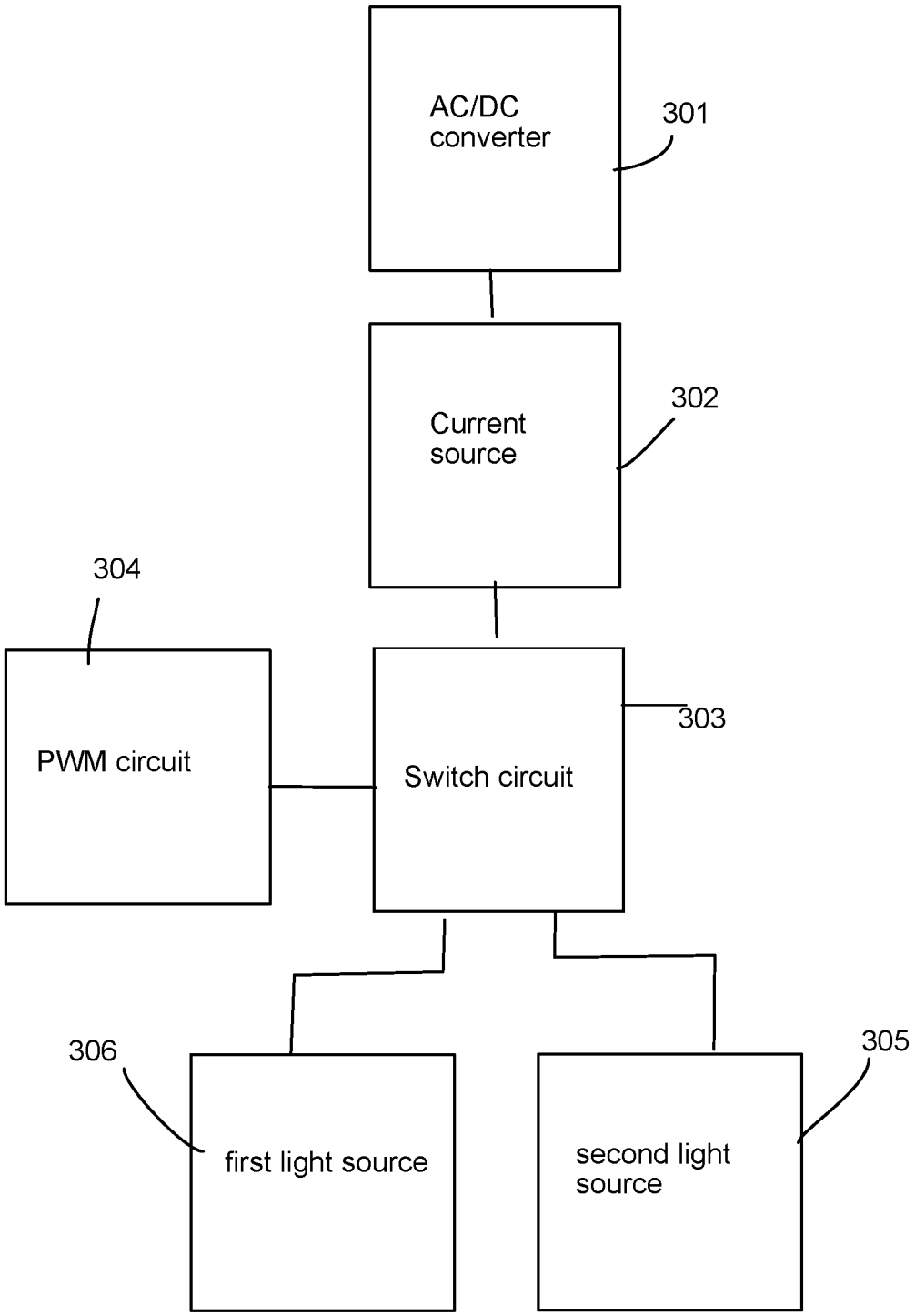
FIG. 1 illustrates a first embodiment of a lighting apparatus with a driver circuit for providing color temperature mixing function.

Please refer to FIG. 1. In FIG. 1, a lighting apparatus includes a first light source 306, a second light source 305, a current source 302, a switch circuit 303 and a PWM circuit 304. In some examples, there is also an AC/DC converter 301.

The switch circuit 303 receives a PWM signal from the PWM circuit 304 and distributes a driving current in alternating order to either the first light source 306 or the second light source 305.

According to a preferred embodiment, a lighting apparatus includes a first light source, a second light source, a current source, a pulse width modulation (PWM) circuit for generating a PWM signal and a switch circuit.

The first light source emits a first light with a first optical parameter. The second light source emits a second light with a second optical parameter. The first optical parameter and the second optical parameter comprise color temperature and/or light spectrum distribution, e.g. different strengths on different frequency segments. The first light source and the second light source may each include one more than one LED modules. To emit different color temperatures, different fluorescent layers may be disposed upon LED chips for generating different color temperatures.

The current source generates a driving current. For example, the current source may be various constant current circuits that may convert DC (Direct Current) or AC (Alternating Current) to a suitable driving current for driving LED modules to emit light.

The pulse width modulation (PWM) circuit is used for generating a PWM signal.

The switch circuit guides the driving current to either the first light source or the second light source by reference to the PWM signal so as by mixing the first light of the first optical parameter and the second light of the second optical parameter to obtain a desired mixed output light of a mixed optical parameter.

In some embodiments, when the PWM signal is at high level, the switch circuit guides the driving current to the first light source, and when the PWM signal is at low level, the switch circuit guides the driving current to the second light source. Usually, a PWM signal is a square wave that has consecutive high voltage levels and low voltage levels. When the PWM signal is at high voltage level, e.g. the PWM signal being at high level, the driving current is directed to drive the first light source. When the PWM signal is at low voltage level, e.g. the PWM signal being at low level, the driving current is directed to the second light source.

In some embodiments, the first optical parameter is a first color temperature and the second optical parameter is a second color temperature and a mixed color temperature of the mixed output light is adjusted by changing the PWM signal. For example, in a time period, the first light source is turned on for 70% of time while the second light source is turned on for 30% of time. In such case, the mixed color temperature appears to be 70% of the color temperature of the first light source plus 30% of the color temperature of the second light source.

In some embodiments, the first light source and the second light source do not receive the driving current at the same time. In other words, the first light source and second light source are controlled not to turn on at the same time according to the PWM signal.

In some embodiments, the first light source and the second light source are LED light sources.

In some embodiments, the PMW signal is also supplied to the current source for determining a current value of the driving current. In other words, the same PWM signal is used for adjusting or determining the mixed color temperature and also used for adjusting or determining the overall driving current, so as to adjust luminance level.

In some embodiments, the light apparatus also includes an AC/DC converter for converting an AC power source to a DC power source supplying to the current source for generating the driving current.

In some embodiments, the switch circuit includes a first switch unit connected in series with the first light source forming a first light path. A control gate of the first switch unit receives the PWM signal. The switch circuit also includes a second switch unit connected in series with the second light source forming a second light path. The second light path is connected with the first light path in parallel.

There is a one-way conductive unit with a first terminal connected to a control gate of the second switch unit and a first output terminal of the current source. A second terminal of the one-way conductive unit is connected between the first switch unit and the first light source.

In some embodiments, the first switch unit and the second switch unit are transistors.

In some embodiments, the switch circuit further includes a first voltage divider. The first voltage divider includes a first voltage divider resistor and a second divider resistor connected with the first light path in parallel. The control gate of the first switch unit is connected between the first voltage divider resistor and the second voltage divider resistor.

In some embodiments, the switch circuit may further include a second voltage divider. The second voltage divider includes a fourth voltage divider resistor and a fifth voltage divider resistor. The second voltage divider is connected with the second light path in parallel. The control gate of the second switch unit is connected between the fourth voltage divider resistor and the fifth voltage divider resistor.

In some embodiments, the switch circuit may also include a third voltage divider. The third voltage divider includes a third voltage divider resistor. The third voltage divider resistor is connected between a second terminal of the one-way conductor and a second output terminal of the current source.

In some embodiments, the one-way conductor is a diode device. The first output terminal is a positive terminal of the current source, and the second output terminal is a negative terminal of the current source.

In some embodiments, the lighting apparatus may also include a tuner module connected to the current source for adjusting the driving current according to the PWM signal.

In some embodiments, the lighting apparatus may also further include a tuner module connected to the current source for adjusting the driving current by inputting a second PWM signal.

Figure 2:
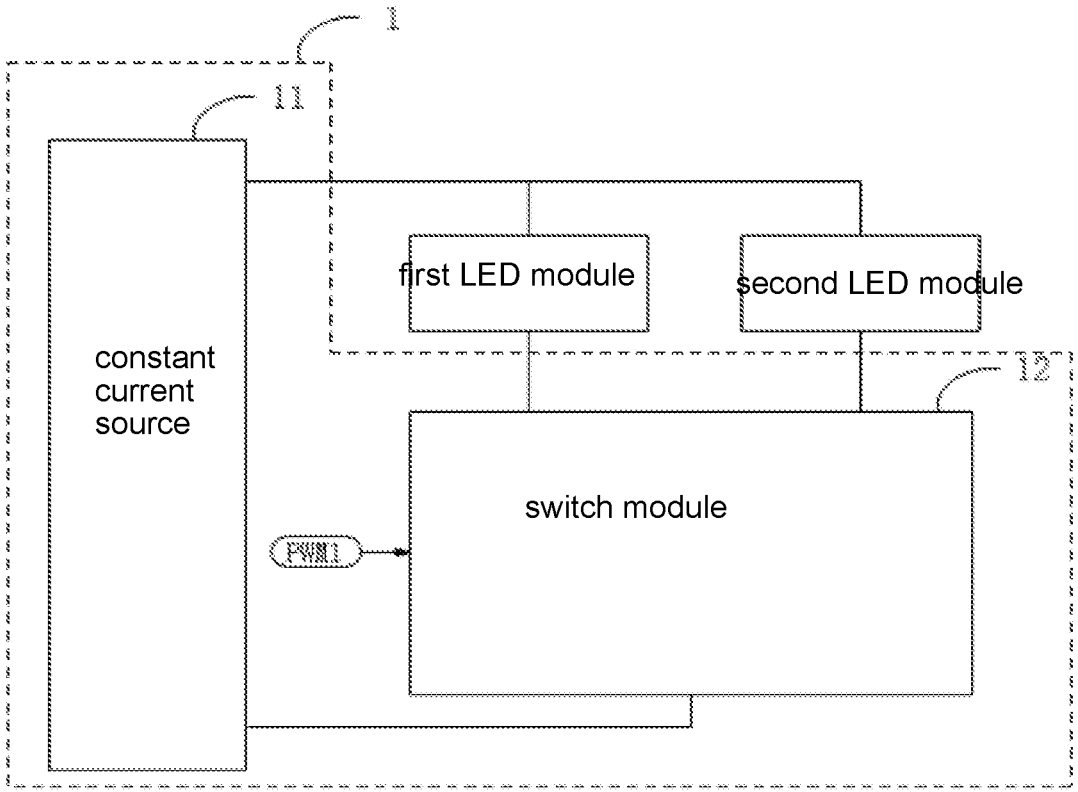
FIG. 2 illustrates an embodiment of a lighting apparatus.

Please refer to FIG. 2, which shows an embodiment. In FIG. 2, the embodiment illustrates a lighting apparatus with color temperature adjusting or determining function by mixing multiple LED modules with different color temperatures. The first light source may be selected with a warm color temperature while the second light source may be selected with a cold color temperature. The first light source may include more than one LED modules connected in series or in other combination manner. The second light source may include more than one LED modules connected in series or in other combination manner.

In the example of FIG. 1, the lighting apparatus includes a constant current source 11. The constant current source 11 receives a power input and converts the power input into a constant current supplying to two LED light sources.

The switch module 12 includes a PWM signal input terminal for receiving a PWM signal from a PWM circuit as a color temperature control signal.

The switch module 12 also includes two terminals respectively connected to a first LED module 171 and a second LED module 172 with different color temperatures.

In this example, the constant current source 11 has its positive output terminals respectively connected to the first LED module 171 and the second LED module 172. The LED module 171 and the second LED module 172 then further connect to a negative output terminal of the constant current source 11 via the switch module 11.

The switch module 12 uses its internal circuit to decode the PWM signal to control a first light path of the first LED module 171 and a second light path of the second LED module 172 to turn on and turn off in a corresponding on/off ratio to produce desired color temperature.

For example, when the PWM signal is at high voltage level, the first LED module 171 is turned on and the second LED module 172 is turned off. When the PWM signal is at low voltage level, the first LED module 171 is turned off and the second LED module 172 is turned on.

In such design, only one of the first LED module 171 and the second LED module 172 receives the driving current and thus, the overall consumed current is kept constant.

Such design may avoid undesired blink while the current is kept constant and stable. In addition, only one PWM circuit is necessary and thus the overall cost is decreased at the same time.

Figure 3:
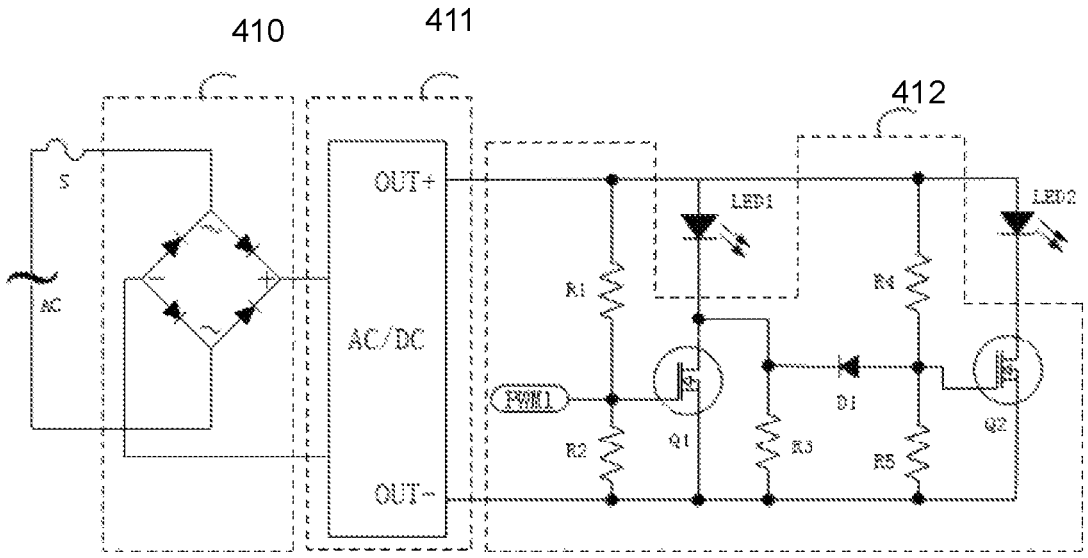
FIG. 3 illustrates a circuit diagram for an example to implement the lighting apparatus.

Please refer to FIG. 3. In FIG. 3, a circuit diagram is provided to teach, not to limit the invention scope, persons of ordinary skilled in the art to enable the invention.

The lighting apparatus in FIG. 3 includes a constant module 411. The constant current module 411 receives a power input and converts the power input to a constant current supplying to two LED modules. In this example, the constant current module 411 includes an AC/DC conversion module for converting an AC power input to a DC output.

The switch module 412 controls turn-on and turn-off of the first LED module and the second LED module according to a PWM signal. In the same time, the switch module 412 keeps the sum of current used by the first LED module and the second LED module.

Specifically, the switch module 12 includes a first transistor Q1, a second transistor Q2 and a one-way conductor unit D1. The first transistor Q1 and the second transistor Q2 may be field effect transistors.

The first transistor Q1 and the first LED module LED1 are connected in series forming a first light path. The control gate of the first transistor Q1 receives a PWM signal. The second transistor Q2 and the second LED module LED2 are connected in series forming a second light path.

The second light path and the first light path are connected in parallel. The positive terminal of the one-way conductor unit D1 is connected to the control gate of the second transistor Q2 and the positive output OUT+ of the constant current module 411. The negative terminal of the one-way conductor unit D1 is connected between the first transistor Q1 and the first LED module LED module.

In this example, the positive terminals of the two LED modules respectively connect to the positive output terminals OUT+. The negative terminals of the two LED modules are respectively connected to drain ends of the two transistors. The source ends of the transistors are respectively connected to the negative output terminal OUT− of the constant current module 411.

When the PWM signal is at high voltage level, the first transistor is turned on and the current of the constant current module is output via the terminal OUT+ to the first LED module LED1, the transistor Q1 and the terminal OUT−.

In such case, the first transistor Q1 is turned on, the drain end of the first transistor Q1 is at low voltage level, which means the negative terminal of the one-way conductor unit D1 is at low voltage level. Because the one-way conductor unit Q1 only allows one-way connection, the positive terminal of the one-way conductor unit Q1 is also at low voltage level, which means the control gate of the second transistor Q2 being at low voltage level.

In other words, the second transistor Q2 is turned off in such time. The second LED module LED2 is turned off and not emitting light.

When the PWM signal is at low voltage level, the first transistor Q1 is turned off. The first LED module LED1 is turned off. Because the first transistor Q1 is turned off, the drain end of the first transistor Q1 is at high voltage level, which means the negative terminal of the one-way conductor unit D1 is at high voltage level. Meanwhile, the positive terminal of the one-way conductor unit D1 is also at high voltage which is the same in the positive output terminal OUT+ of the constant current module 411. Also, the control gate of the second transistor Q2 is at high voltage level and thus the second transistor Q2 is turned on and causes the second LED module LED2 to turn on.

In other words, the driving current output by the constant current module 411 is either directed to the first LED module LED1 or the second LED module LED2.

The switch module 412 further includes a first voltage divider unit connected to the first light path in parallel. The first voltage divider unit includes a first voltage divider resistor R1 and a second voltage divider resistor R2.

The control gate of the first transistor Q1 is connected between the first voltage divider resistor R1 and the second voltage resistor R2.

The switch module 412 also includes a second voltage divider unit connected to the second light path in parallel. The second voltage divider includes a fourth voltage divider resistor R4 and a fifth voltage divider resistor R5. The control gate of the second transistor Q2 is connected between the fourth voltage divider resistor R4 and the fifth voltage divider resistor R5.

The switch module 412 also includes a third voltage divider unit. The third voltage divider unit includes a third voltage divider resistor R3. The third voltage divider R3 is connected between the negative terminal of the one-way conductor unit D1 and the negative terminal OUT− of the constant current module 411.

In this example, the one-way conductor unit D1 is a diode device.

Furthermore, the lighting apparatus may include a rectifier like a bridge module.

It is to be understood that the forms of the invention shown are preferred embodiments thereof and that various changes and modifications may be made therein without departing from the spirit of the invention or scope as defined in the following claims.

The invention claimed is:

1. A lighting apparatus, comprising:

a first light source for emitting a first light with a first optical parameter;

a second light source for emitting a second light with a second optical parameter;

a current source for generating a driving current;

a pulse width modulation (PWM) circuit for generating a PWM signal;

a switch circuit for guiding the driving current to either the first light source or the second light source by reference to the PWM signal so as by mixing the first light of the first optical parameter and the second light of the second optical parameter to obtain a desired mixed output light of a mixed optical parameter, wherein switch circuit comprises:

a first switch unit connected in series with the first light source forming a first light path, a control pate of the first switch unit receiving the PWM signal;

a second switch unit connected in series with the second light source forming a second light path, the second light path being connected with the first light path in parallel; and a one-way conductive unit with a first terminal connected to a control pate of the second switch unit and a first output terminal of the current source, a second terminal of the one-way conductive unit being connected between the first switch unit and the first light source; wherein the switch circuit further comprises:

a first voltage divider comprising a first voltage divider resistor and a second divider resistor connected with the first light path in parallel, wherein the control gate of the first switch unit is connected between the first voltage divider resistor and the second voltage divider resistor;

a second voltage divider comprising a fourth voltage divider resistor and a fifth voltage divider resistor and being connected with the second light path in parallel, wherein the control gate of the second switch unit is connected between the fourth voltage divider resistor and the fifth voltage divider resistor; and a third voltage divider comprising a third voltage divider resistor, the third voltage divider resistor being connected between a second terminal of the one-way conductor and a second output terminal of the current source.

2. The lighting apparatus of claim 1, wherein when the PWM signal is at high level, the switch circuit guides the driving current to the first light source, and when the PWM signal is at low level, the switch circuit guides the driving current to the second light source.

3. The lighting apparatus of claim 1, wherein the first optical parameter is a first color temperature and the second optical parameter is a second color temperature and a mixed color temperature of the mixed output light is adjusted by changing the PWM signal.

4. The light apparatus of claim 1, wherein the first light source and the second light source are LED light sources.

5. The light apparatus of claim 1, wherein the first light source and the second light source do not receive the driving current at the same time.

6. The light apparatus of claim 1, wherein the PMW signal is also supplied to the current source for determining a current value of the driving current.

7. The light apparatus of claim 1, further comprising an AC/DC converter for converting an AC power source to a DC power source supplying to the current source for generating the driving current.

8. The lighting apparatus of claim 1, wherein the first switch unit and the second switch unit are transistors.

9. The lighting apparatus of claim 1, wherein the one-way conductor is a diode device, the first output terminal is a positive terminal of the current source, the second output terminal is a negative terminal of the current source.

* * * * *